United States Patent [19]

Althaus

[11] Patent Number: 5,063,668

[45] Date of Patent: Nov. 12, 1991

[54] RAZOR HEAD, ESPECIALLY RAZOR BLADE UNIT, OF A WET RAZOR

[75] Inventor: Wolfgang Althaus, Wuppertal, Fed. Rep. of Germany

[73] Assignee: Wilkinson Sword Gesellschaft mit beschränkter Haftung, Solingen, Fed. Rep. of Germany

[21] Appl. No.: 682,199

[22] Filed: Apr. 4, 1991

[30] Foreign Application Priority Data

Apr. 27, 1990 [DE] Fed. Rep. of Germany ... 9004760[U]

[51] Int. Cl.[5] ..... B26B 21/14

[52] U.S. Cl. ..... 30/77; 30/50

[58] Field of Search ..... 30/47–50, 30/77–78, 81, 32, 346.58

[56] References Cited

U.S. PATENT DOCUMENTS 3,505,734 4/1970 Iten ..... 30/50
3,872,592 3/1975 Iten .

FOREIGN PATENT DOCUMENTS 0306710 3/1989 European Pat. Off. .
8711506 8/1987 Fed. Rep. of Germany .
8811356 9/1988 Fed. Rep. of Germany .
3814135 11/1988 Fed. Rep. of Germany .

*Primary Examiner*—Douglas D. Watts
*Attorney, Agent, or Firm*—Robert W. Becker & Associates

[57] ABSTRACT

A razor head, and especially a razor blade unit, is disposed at the front end of a handle of a wet razor. The razor head comprises a plastic body having an upper side that defines a surface for engaging the skin of a user. The plastic body also has a front side and a back side. A single or double razor blade is disposed in the plastic body. A wire, portions of which, in the vicinity of the upper side of the plastic body, extend over cutting edges of the razor blades at a distance from one another and parallel to a direction of shaving. Guide elements are distributed over the length of the plastic body in the vicinity of both the front and back sides thereof, with the guide elements being provided for guiding the wire in a zigzagged manner back and forth over the upper side of the plastic body.

16 Claims, 6 Drawing Sheets

RAZOR HEAD, ESPECIALLY RAZOR BLADE UNIT, OF A WET RAZOR

BACKGROUND OF THE INVENTION

The present invention relates to a razor head, and especially a razor blade unit, disposed at the front end of a handle of a wet razor. A razor blade means in the form of a single or double razor blade is disposed in a plastic body. In the vicinity of the upper side of the razor head that defines a surface for engaging the skin of a user, portions of a wire extend over the cutting edges of the razor blade means at a distance from one another and parallel to the direction of shaving.

Various embodiments of wet or safety razors are known. In each case, disposed at the front end of a handle is a razor head that carries the single or double razor blade. The razor head can be integrally formed with the handle as a molded plastic part. If the razor head is separate from the handle and is to be secured thereto in an exchangeable manner via an appropriate mechanism, it is designated as a so-called razor blade unit, with a single or double razor blade being fixedly embedded in a plastic housing.

A razor head in the form of such a razor blade unit is disclosed in DE-GM 87 11 506. A wire having a number of adjacent windings is wound around the plastic body in which the double razor blade is embedded. In the vicinity of the surface of the razor blade unit that engages the skin of a user, the individual windings extend at a distance from one another and parallel to the direction of shaving, while at the underside of the plastic body the windings extend at an angle. This protective wire winding significantly improves the shaving characteristics. For example, the wire prevents the formation of folds or bulges of the skin, so that injury to the skin can also be prevented in non-visible areas. Furthermore, the wire reduces the actual shaving resistance, since it reduces the frictional forces. Finally, the protective wire prevents the user from accidentally cutting himself during improper handling of the razor blade unit at the razor blades thereof.

Unfortunately, with the heretofore known razor head the wire, due to the fact that it is helically wound about the plastic body, also extends in the vicinity of the underside of the razor blade unit, namely in the region where the razor blade unit must be secured to the handle. Thus, the windings of the wire and the securing mechanism interfere with one another. Furthermore, with the wire winding of the heretofore known razor blade unit, the danger exists that the wire can shift to the side.

It is therefore an object of the present invention to provide a razor head, and in particular a razor blade unit, that has an improved wire winding.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
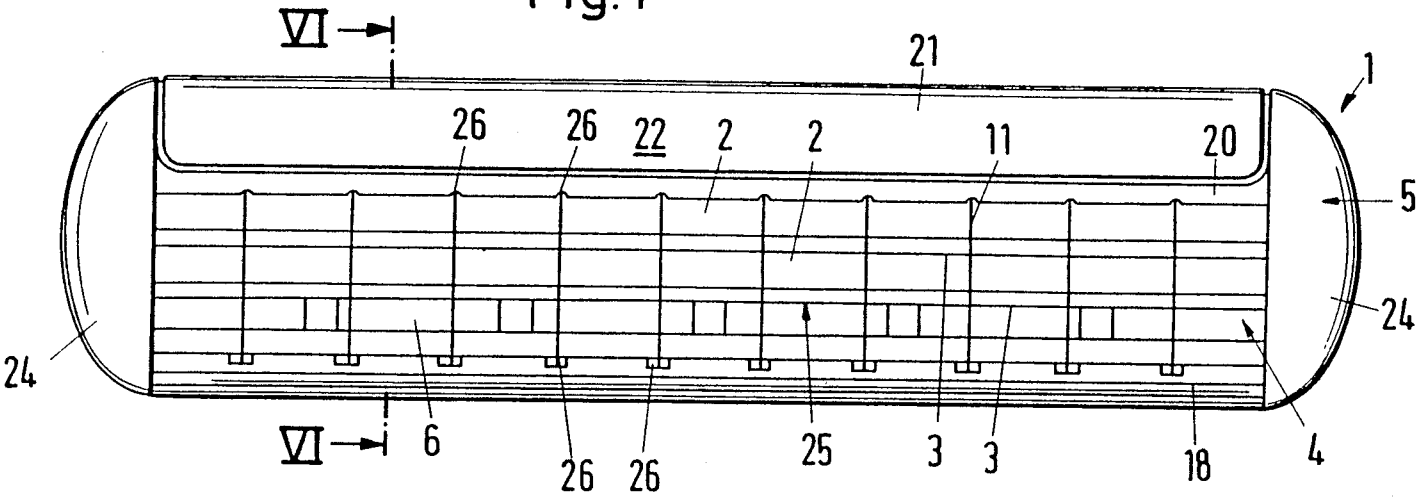
FIG. 1 is a top view of one exemplary embodiment of the inventive razor head in the form of a razor blade unit of a wet razor.
Figure 2:
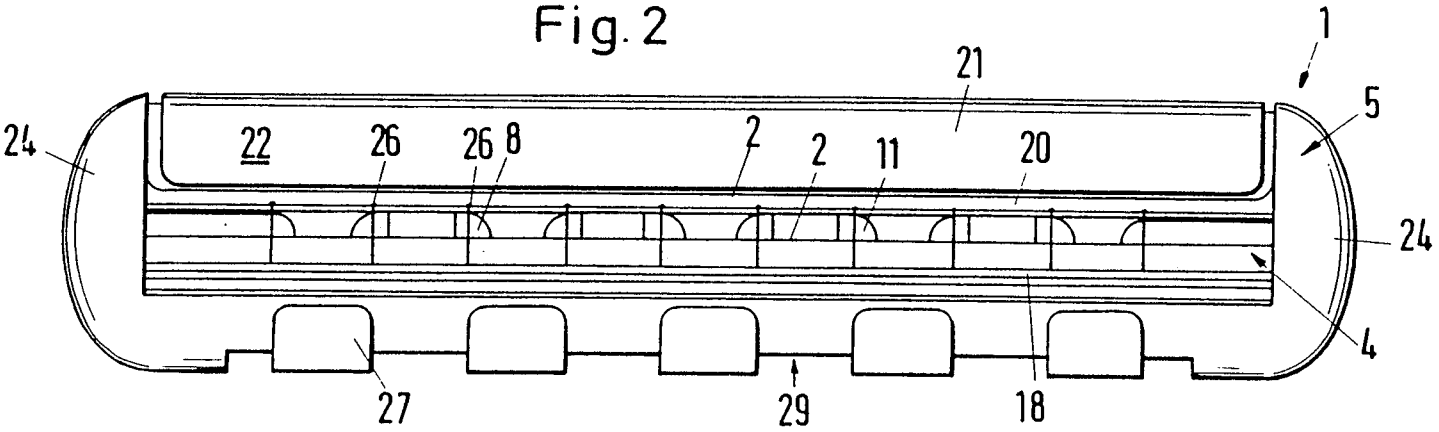
FIG. 2 is a front view of the razor blade unit of FIG. 1.
Figure 3:
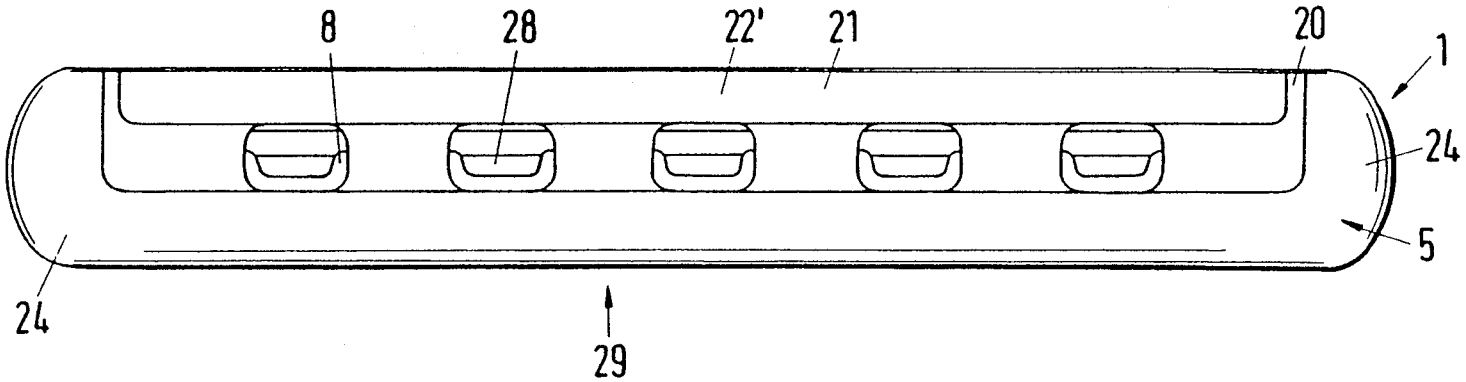
FIG. 3 is a rear view of the razor blade unit of FIG. 1.
Figure 4:
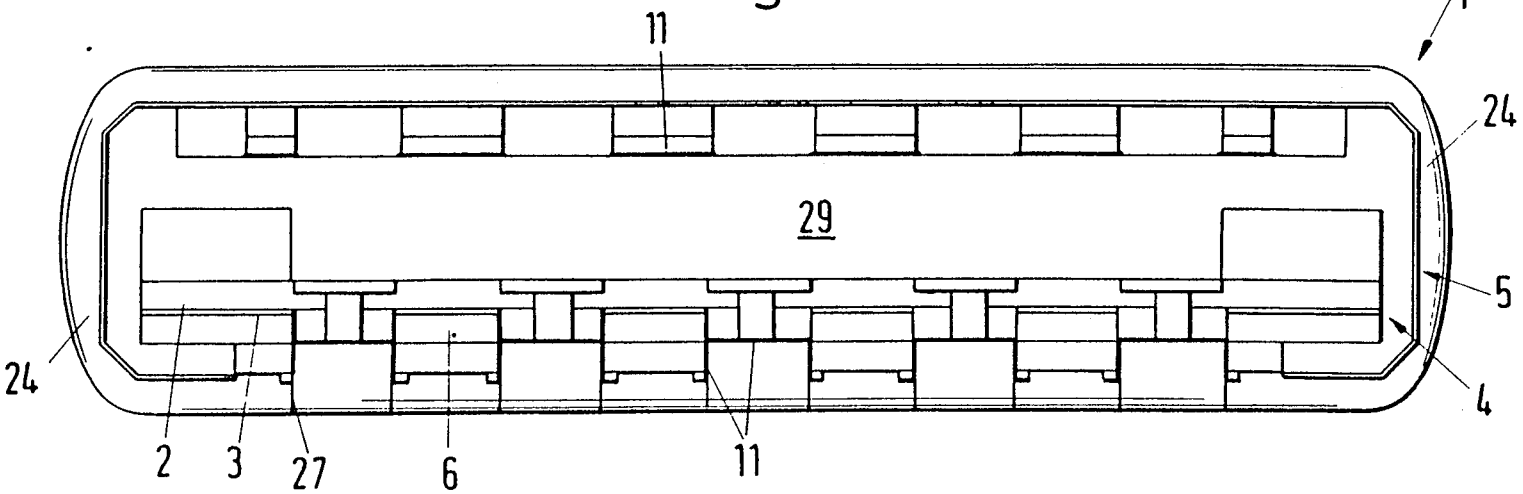
FIG. 4 is a bottom view of the razor blade unit of FIG. 1.
Figure 6:
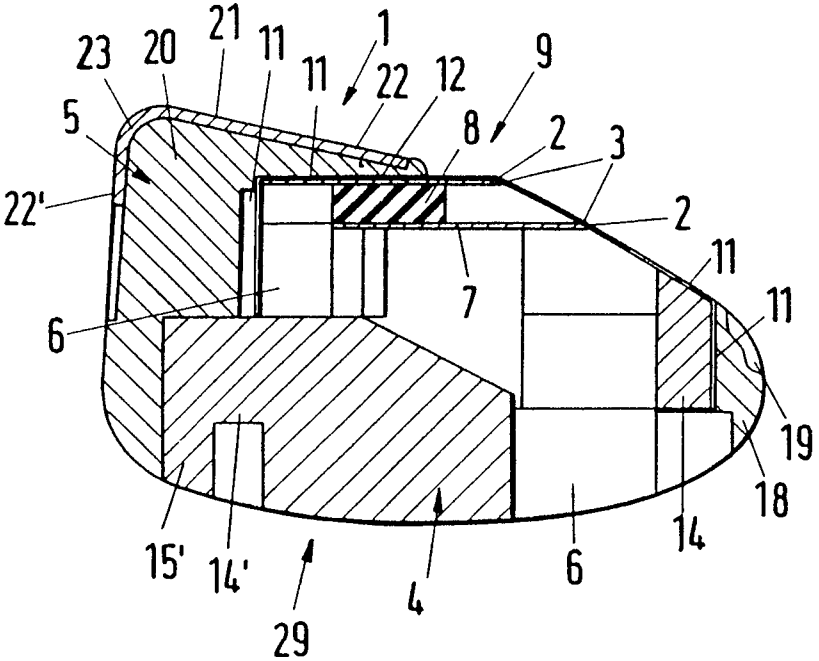
FIG. 6 is an enlarged cross-sectional view taken along the line VI—VI in FIG. 1.
Figure 5:
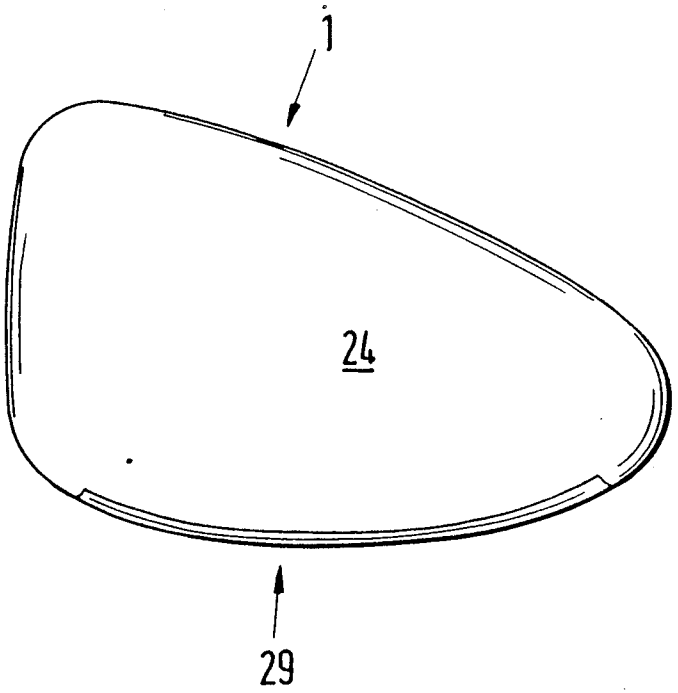
FIG. 5 is an enlarged side view of the razor blade unit of FIG. 1.
Figure 7:
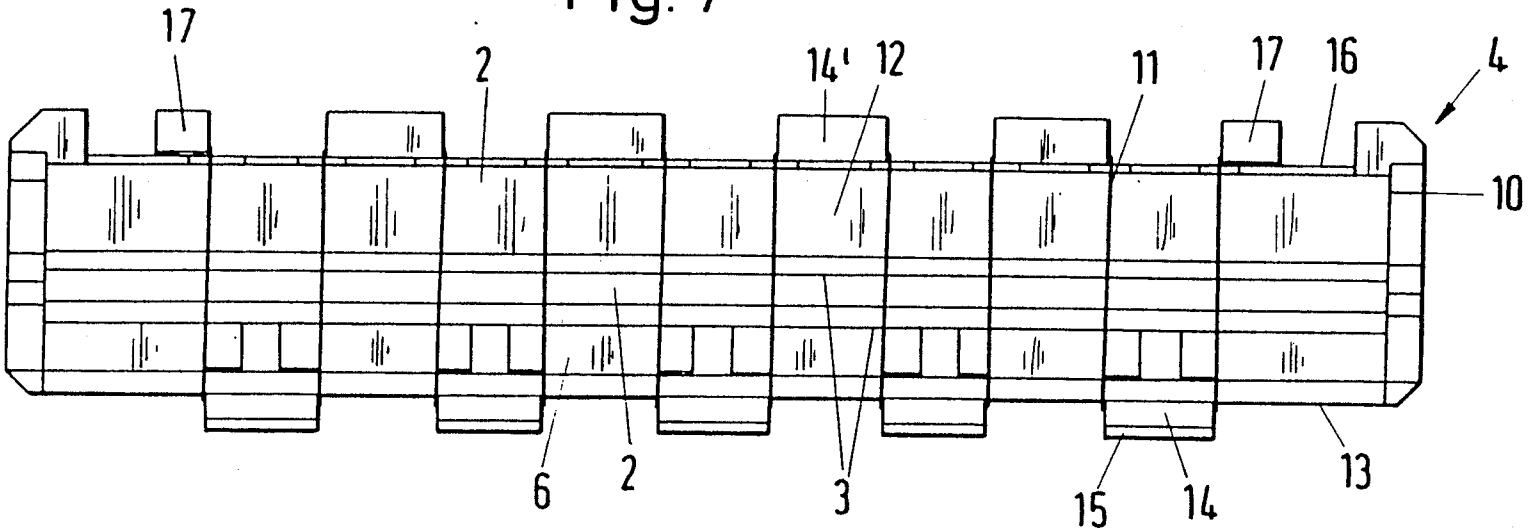
FIG. 7 is a top view of the base member of the razor blade unit without the upper part, which is formed by the forward guide strip, the rear cover, and the side walls.
Figure 8:
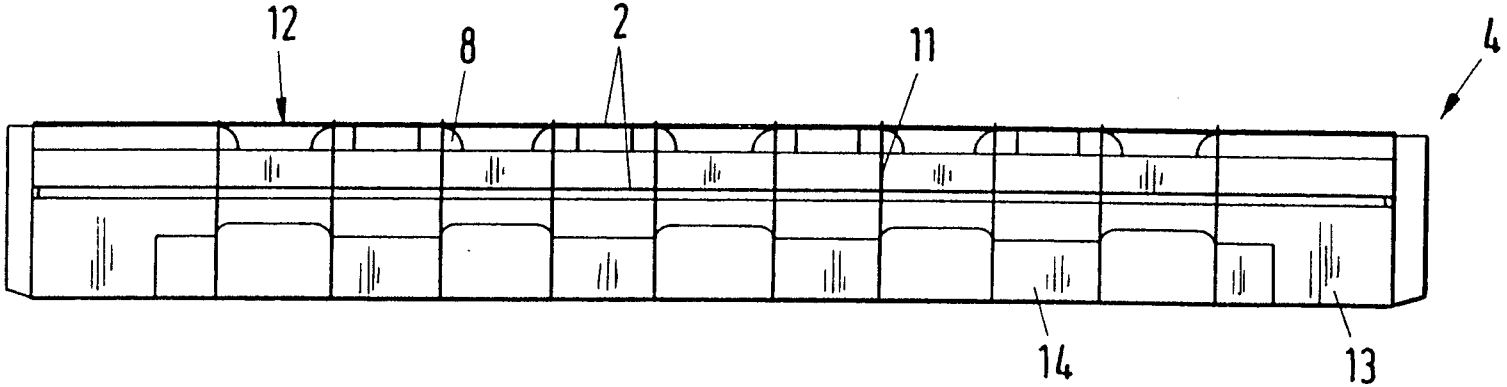
FIG. 8 is a front view of the base member.
Figure 9:
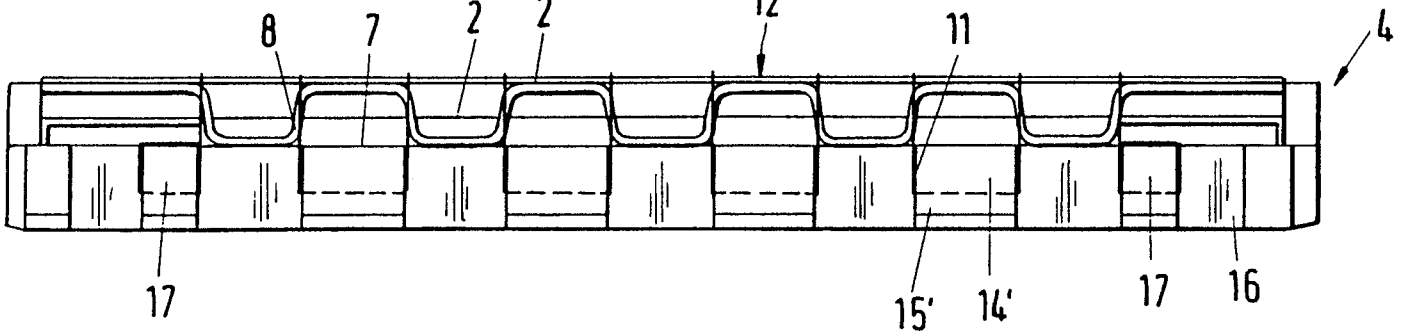
FIG. 9 is a rear view of the base member.
Figure 10:
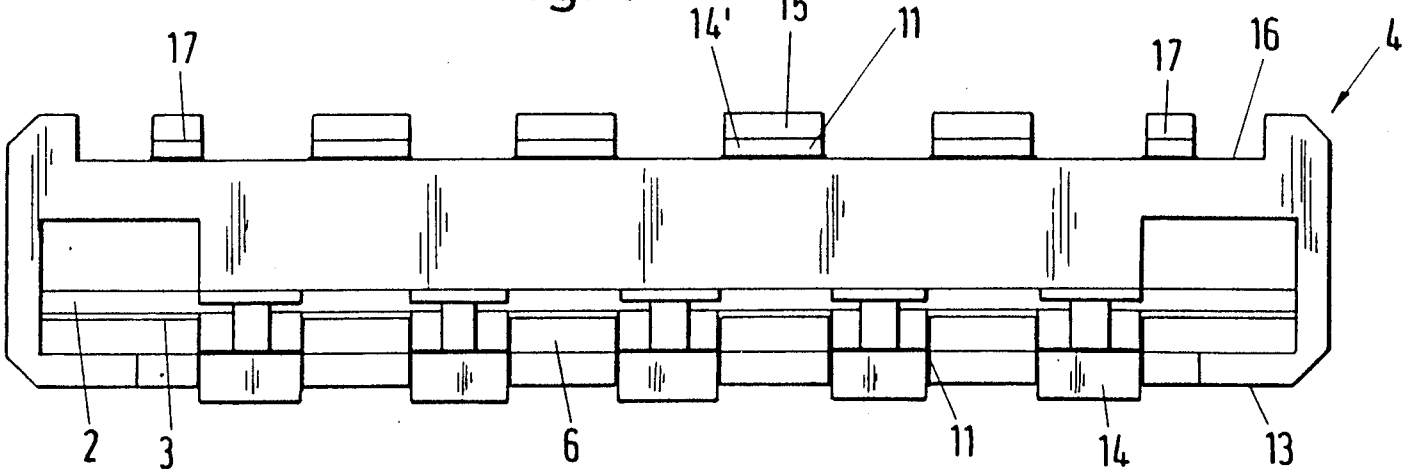
FIG. 10 is a bottom view of the base member.
Figure 11:
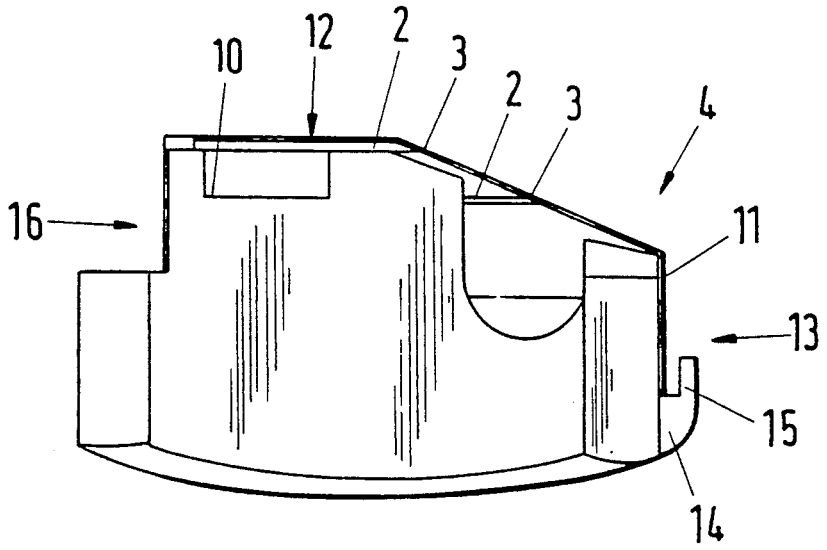
FIG. 11 is an enlarged side view of the base member.

The razor head of the present invention is characterized primarily by guide elements that are distributed over the length of the plastic body in the vicinity of both the front side and the back side thereof, with these guide elements being provided for guiding the wire in a zigzagged manner back and forth over the upper side of the plastic body.

A razor head, and in particular a razor blade unit, that is constructed pursuant to the teaching of the present invention has the advantage that the underside of the plastic body remains free, so that the handle can be secured to the underside of the razor head without difficulty. Thus, in particular in the case of razor blade units, all possible securement systems can be realized. Furthermore, with the inventive orientation of the protective wire, a shifting of this wire to the side is prevented. The "zigzagged guidance" of the wire refers to the fact that in the operative region the wire portions extend parallel to the direction of shaving and in particular extend equidistantly from one another. Beyond the operating region of the wire portions, in the vicinity of the front and back sides of the plastic body, the direction of the wire is reversed by 180° in order to effect the back and forth guidance of the wire.

Pursuant to one preferred specific embodiment of the present invention, the guide elements are embodied as projections of the plastic body, with wire being guided about these projections. In this connection, the projections are integral with the plastic body, thereby avoiding any technical manufacturing problems. The wire is in each case guided about the outside of the projections.

The projections can have any desired configuration. For example, it is conceivable, for guiding the return of a wire portion, to provide two spaced-apart pins, the spacing of which essentially corresponds to the spacing of the parallel wire portions. However, pursuant to one preferred specific embodiment of the present invention, the projections have a width that essentially corresponds to the distance between the projections. Thus, the projections are embodied as ramps or strips that extend parallel to the cutting edges of the razor blades; it should be noted that "width of the projections" refers to the linear extensions of the projections parallel to the cutting edges of the razor blades. With this embodiment of the projections, the latter are offset or staggered relative to one another in relation to the front and back sides of the plastic body, i.e. the projections at the front side fill the gaps of the projections at the back side, and vice versa. This ensures a parallel orientation of the wire portions in the work region.

Pursuant to a further specific embodiment of the present invention, it is proposed that each end of the plastic body, preferably in the region of the back side, be provided with a securing projection for securing the two ends of the wire. This represents a technically very straightforward possibility for securing the ends of the wire to the plastic body.

Pursuant to one preferred specific embodiment of the razor head, the razor blade means is essentially inserted from above onto a platform or support means of the plastic body, where it is held by the wire. Thus, the wire is simultaneously used for securing the razor blade means to the support means, thus eliminating the need for some other securement, for example in the nature of rivets.

If a double razor blade is provided, it is proposed pursuant to a further specific embodiment that the two razor blades be secured to both sides of a spacer that is disposed between them, with the thus-formed razor blade/spacer/razor blade unit essentially being inserted from above onto a platform or support means of the plastic body, where it is held by the wire. The advantages mentioned in connection with a single razor blade also apply to this embodiment, in particular the elimination of a securement via rivets.

If the razor head has a rear cover and a forward guide strip, which is preferably provided with a stepped longitudinal profiling, it is proposed pursuant to a further specific embodiment of the present invention that in the vicinity of the guide strip and the cover, the wire be guided below these components and be covered thereby. Thus, the wire extends between the guide strip or cover and the actual plastic body with its blade support means. As a consequence of this configuration, the function of the forward guide strip, especially with its stepped longitudinal profiling, is not reduced by the friction-reducing wire portions, since the forward guide strip is particularly required for prestressing the skin. The same applies to the function of the cover, which is not adversely affected by having a wire extend thereover.

In a preferred specific embodiment of this concept, the guide strip and the cover are interconnected by side strips, especially by side walls, while leaving a central opening in the region of the cutting edge or edges of the razor blade means; the thus-formed upper part of the plastic body is placed upon the base member of the plastic body with its razor blade means that is secured to a support means of the base member via the wire, whereupon the upper part is securely connected to the base member. Thus, as a consequence of this one-piece upper part, which is formed from the forward guide strip, the rear cover, and the side strips, a simple assembly of the razor head, and in particular of the razor blade unit, is provided. After the single or in particular double razor blade is secured to the support means of the base member via the wire, it is merely necessary to insert the upper part essentially from above onto the base member and to securely connect it thereto. This can be effected, for example, in an interlocking manner or in any other suitable fashion.

So that the wire does not interfere, and in order to provide an additional guidance therefor, it is proposed pursuant to a further specific embodiment of the present invention that the inner sides of the guide strip and cover that face the wire be provided with receiving grooves for the wire.

Pursuant to a further specific embodiment of the upper part, the latter is provided with recesses that interengage with the projections of the base member of the plastic body. This provides an optimum mutual coordination of the upper part with the base member of the plastic body.

Pursuant to a further specific embodiment of the present invention, the cover is provided with a friction-reducing glide or anti-friction strip. This glide strip is preferably convexly curved, and pursuant to one preferred specific embodiment has a forward, essentially planar or slightly convexly curved leg as well as a rear, similarly essentially planar or slightly convexly curved leg that is disposed at an angle to the forward leg, with these two legs being interconnected via a rounded portion. Such a glide strip that is curved over the cover can be produced via a special hot molding process and can be applied. The particular advantage of such a configuration is that the glide strip is also more effective at the end of the razor head. Since the skin is made taut during shaving and is pressed in, a bulge is formed at the end of the razor head. The curved glide strip optimally glides in this region, and thus increases a comfortable shave.

Further specific features of the present invention will be described in detail subsequently.

DESCRIPTION OF PREFERRED EMBODIMENTS

Referring now to the drawings in detail, the illustrated razor head, which is in the form of a so-called razor blade unit for a wet or safety razor, and can be secured to the front end of a non-illustrated handle, comprises a plastic body 1 in which are disposed two razor blades 2, the cutting edges 3 of which extend parallel to one another and are offset one behind the other.

The plastic body 1 comprises a base member 4 that is provided with the razor blades 2, as well as an upper part 5 that is placed upon the base member 4.

The base member 4 of the plastic body 1 is provided with through slots 6 that are primarily disposed in the interior thereof. On the upper side, the base member 4 defines a platform or support means 7 for the razor blades 2. For this purpose, a spacer 8 is sandwiched between the two razor blades 2, which are securely connected to this spacer. These components thus form a razor blade/spacer/razor blade unit 9, which is placed from above upon the support means 7 of the base member 4. For this purpose, the spacer 8 projects out to the side and is received in recesses or slots 10 in the sides of the base member 4.

The unit 9 is held via a wire or other filament 11 that extends in a zigzagged or staggered manner; the wire 11 is guided over the upper side 12 of the unit 9, and hence of the base member 4 of the plastic body 1. To guide the wire 11, the lower portion of the front side 13 of the base member 4 is provided with downwardly directed, integral projections 14 that are embodied as elongated strips. The width of these projections 14 as viewed in the direction of the cutting edges 3 of the razor blades 2 essentially corresponds to the spacing between the projections 14. Toward the front, the projections 14 are provided with an upwardly extending extension 15.

In a similar manner, the back side 16 of the base member 4 is provided with projections 14' that are directed toward the rear. These projections 14' fill the gaps between the projections 14 of the front side 13. In a manner similar to the construction of the projections 14, the projections 14' are also provided with extensions 15', which, however, are directed downwardly. Finally, the back side 16 of the base member 4 is provided near its ends with respective integral mounting or securing projections 17.

One end of the wire 11 is first secured to one of the securing projections 17. Subsequently, the wire 11 is guided over the unit 9 toward the front and about a projection 14, whereupon it is turned by 180° to again extend toward the rear over the unit 9, where the wire 11 is guided about a pertaining projection 14'. The wire 11 is thus sequentially guided about the projections 14 and 14', whereupon the other end of the wire is finally secured to the securing projection 17 disposed at the other side of the base member 4. In this connection, portions of the wire 11 disposed in the region of the upper side 12 extend parallel to one another and essentially equidistantly from one another. The wire 11 serves a dual function of holding the unit 9 securely in place upon the support means 7 on the base member 4, and also preventing injury to the skin.

The upper part 5 is a one-piece plastic component and is provided with a forward guide strip 18 that extends parallel to the cutting edges e of the razor blades 2 and is provided with a stepped longitudinal profiling 19. A protective cover 20 is provided in the back region. This cover is provided at the top with a convexly curved glide or antifriction strip 21 having a first leg 22 and a second leg 22' that is disposed at an acute angle to the first leg 22 and is interconnected therewith via a rounded portion 23. The angle between the two legs 22, 22' of the glide strip 21 can also be 90° or an obtuse angle. The two legs 22, 22' of the glide strip 21 have an essentially planar or slightly convexly curved configuration. It is possible to produce such a glide strip 21 via a special hot mold process. The particular advantage of this glide strip 21 is that it is also more effective at the end of the razor blade unit. Since when shaving the skin is made taut and is pressed in, a bulge is formed at the end of the razor blade unit. Thus, the curved glide strip 21 glides better in this region and thus increases a comfortable shave.

The forward guide strip 18 and the rear cover 20 are interconnected by side walls 24. Disposed between these components is an opening 25 in the vicinity of the cutting edges 3 of the razor blades 2, as can be seen in particular in the top view of FIG. 1.

Both the inner side of the guide strip 18 as well as the inner side of the cover 20 are provided with receiving grooves 26 for the wire 11. Recesses 27 are provided below the guide strip 18 that interengage in a corresponding manner with the projections 14 of the base member 4. The back of the upper part 5, which is formed from the guide strip 18, the cover 20 and the side walls 24, is provided with through passages 28 that correspond with appropriate through passages in the spacer 8.

In the finish installed state, the upper part 5 is placed from above upon the base member 4, which includes the unit 9 that is secured by the wire 11. The upper part 5 is secured in place in, for example, an interlocking manner, or in any other convenient manner. The wire 11 extends in the receiving grooves 26 provided on the inner side of the upper part 5.

Extending the wire 11 in the vicinity of the upper side 12 has the advantage that the underside 29 of the plastic body 1 remains free, so that appropriate mounting or securing systems can be provided.

The present invention is, of course, in no way restricted to the specific disclosure of the specification and drawings, but also encompasses any modifications within the scope of the appended claims.

What I claim is:

1. A razor head, and especially a razor blade unit, disposed at the front end of a handle of a wet razor, comprising:

a plastic body having an upper side that defines a surface for engaging the skin of a user, with said plastic body also having a front side and a back side;

razor blade means disposed in said plastic body;

a wire, portions of which, in the vicinity of said upper side of said plastic body, extend over cutting edges of said razor blade means at a distance from one another and parallel to a direction of shaving; and guide elements distributed over the length of said plastic body in the vicinity of both said front and back sides thereof, with said guide elements being provided for guiding said wire in a zigzagged manner back and forth over said upper side of said plastic body.

2. A razor head according to claim 1, in which said guide elements are embodied as projections of said plastic body, with said wire being guided about said projections.

3. A razor head according to claim 2, in which said projections are spaced apart and have a width that essentially corresponds to the spacing between said projections.

4. A razor head according to claim 2, in which end regions of said plastic body are provided with respective securing projections for the securement of ends of said wire.

5. A razor head according to claim 4, in which said securing projections are disposed in the vicinity of said back side of said plastic body.

6. A razor head according to claim 2, in which said plastic body is provided with a support means for receiving said razor blade means thereon, essentially from above, with said wire holding said razor blade means on said support means.

7. A razor blade according to claim 6, in which said razor blade means is a double razor blade connected to opposite sides of a spacer disposed therebetween to form a razor blade/spacer/razor blade unit that is disposed, essentially from above, onto a support means of said plastic body, with said wire holding said razor blade unit on said support means.

8. A razor blade according to claim 2, in which said plastic body comprises a guide strip at said front side and a cover at said back side, with said wire being guided beneath said guide strip and said cover and being covered by the same.

9. A razor blade according to claim 8, in which said guide strip is provided with a stepped longitudinal profiling.

10. A razor blade according to claim 8, in which said plastic body comprises a base member and an upper part, whereby said base member has a support means upon which said razor blade means is secured via said wire, and whereby said upper part is provided with said guide strip and said cover that are interconnected via side strips while leaving a central opening in the vicinity of said cutting edges of said razor blade means, with said upper part being placed upon and securely connected to said base member.

11. A razor blade according to claim 10, in which said side strips are side walls of said plastic body.

12. A razor blade according to claim 10, in which said guide strip and said cover have inner sides that face said wire and are provided with grooves for receiving same.

13. A razor blade according to claim 10, in which said upper part is provided with recesses that interengage with said projections of said plastic body, with said projections being provided on said base member.

14. A razor blade according to claim 10, in which said cover is provided with a glide strip.

15. A razor blade according to claim 14, in which said glide strip is convexly curved.

16. A razor blade according to claim 15, in which said glide strip has a forward, at most slightly convexly curved leg and a rear, at most slightly convexly curved leg, with said rear leg extending at an angle to said forward leg and being connected thereto via a rounded portion.

* * * * *